US007240526B2

(12) United States Patent
Lee

(10) Patent No.: US 7,240,526 B2
(45) Date of Patent: Jul. 10, 2007

(54) LOCK AND A TWO STEP METHOD TO OPEN THE LOCK

(75) Inventor: Miko Lee, Hsinchuang (TW)

(73) Assignee: Grace Lin, Taipei Hsien (TW)

( * ) Notice: Subject to any disclaimer, the term of this patent is extended or adjusted under 35 U.S.C. 154(b) by 196 days.

(21) Appl. No.: 10/900,193

(22) Filed: Jul. 28, 2004

(65) Prior Publication Data

US 2005/0183481 A1 Aug. 25, 2005

(30) Foreign Application Priority Data

Feb. 19, 2004 (TW) ..... 93104047 A

(51) Int. Cl.
*E05B 27/06* (2006.01)

(52) U.S. Cl. ..... 70/358; 70/419; 70/423; 70/454; 70/493

(58) Field of Classification Search ..... 70/358, 70/423, 424, 427, 428, 454, 453, 419, 493
See application file for complete search history.

(56) References Cited

U.S. PATENT DOCUMENTS

| | | | | | |
|---|---|---|---|---|---|
| 321,306 | A | * | 6/1885 | Markham | 70/419 |
| 1,407,267 | A | * | 2/1922 | Hacklander | 70/41 |
| 2,101,779 | A | * | 12/1937 | Kenney | 70/493 |
| 2,439,099 | A | * | 4/1948 | Ressetar | 70/493 |
| 2,552,012 | A | * | 5/1951 | O'Kane | 70/419 |
| 2,682,764 | A | * | 7/1954 | Kotab | 70/419 |
| 3,765,199 | A | | 10/1973 | Wiczer | |
| 4,104,898 | A | * | 8/1978 | Fois | 70/419 |
| 4,490,998 | A | * | 1/1985 | Wellekens | 70/419 |
| 5,163,310 | A | * | 11/1992 | Wang | 70/491 |
| 5,475,997 | A | * | 12/1995 | Chung | 70/375 |
| 5,685,184 | A | | 11/1997 | Gallagher | |
| 5,758,526 | A | * | 6/1998 | Gorokhovsky | 70/375 |
| 6,058,752 | A | * | 5/2000 | Feder | 70/419 |
| 6,079,239 | A | * | 6/2000 | Hsiao | 70/358 |
| 6,748,777 | B1 | * | 6/2004 | Livingston | 70/369 |
| 6,758,073 | B2 | * | 7/2004 | Yu | 70/358 |
| 2003/0037579 | A1 | * | 2/2003 | Wu | 70/358 |

FOREIGN PATENT DOCUMENTS

| | | |
|---|---|---|
| DE | 914588 | 7/1954 |
| DE | 4334379 | 4/1995 |
| DE | 10329691 | 2/2005 |

* cited by examiner

*Primary Examiner*—Suzanne Dino Barrett
(74) *Attorney, Agent, or Firm*—Rosenberg, Klein & Lee

(57) ABSTRACT

A lock includes a cylinder, a cylinder plug and a locking pin assembly. The cylinder plug is rotatably mounted in the cylinder and has a dummy keyhole and a cylinder plug keyhole defined completely through the cylinder plug. The locking pin assembly has multiple locking pins that are slidably partially held in the cylinder plug keyhole. A two step method to open the lock with a key with serrations initially inserts the key serrations into and presses the key serrations completely through the dummy keyhole. Then the serrations are rotated, aligned with and pulled back into the cylinder plug keyhole. Conventional displacement of the locking pins allows the cylinder plug to be rotated, which opens the lock. Pressing the key completely through the lock removes any foreign objects such as toothpicks, chewing gun or pieces of paper and allows the lock to be opened.

6 Claims, 13 Drawing Sheets

LOCK AND A TWO STEP METHOD TO OPEN THE LOCK

BACKGROUND OF THE INVENTION

1. Field of the Invention

The present invention relates to a lock and a two step method to open the lock, and more particularly to a two step method to open a lock where key serrations access lock pins from the back of the lock.

2. Description of Related Art

Locks secure doors, drawers, suitcases, etc. so no one can open them without keys. A conventional lock in accordance with the prior art comprises a cylinder, a cylinder plug, a latch and multiple locking pins. The cylinder has multiple outer pin holes. The cylinder plug is mounted rotatably in the cylinder and has multiple inner pin holes and a keyhole. The inner pin holes are aligned respectively with the outer pin holes. The keyhole is defined in the cylinder plug and communicates with the inner pin holes. The locking pins are spring-loaded pins and are mounted respectively in the outer pin holes. The locking pins extend into and are partially held in the aligned inner pin holes so that the cylinder plug cannot rotate relative to the cylinder. The latch is attached to and rotated by the cylinder plug.

A key having a blade with serrations corresponding to the locking pins is required to open the lock. The key is inserted into the keyhole in the cylinder plug to push the locking pins in the inner pin holes out of the inner pin holes. When the locking pins are flush with the exterior surface of the cylinder plug, the cylinder plug can be rotated relative to the cylinder so that the lock can be opened.

However, a thin and long pick inserted into the lock through the keyhole can push the locking pins out of the pin holes in the cylinder plug to open the lock. Consequently, locks should have an enhanced configuration to prevent the lock from being easy to pick. The aforesaid conventional lock has the following shortcomings.

First, the convention lock is easy to pick. A thin and long pick may be inserted into the keyhole to push the locking pins and open the lock without a key. Therefore, the conventional lock cannot prevent the door, the drawer, the suitcase, etc. from being opened.

Second, foreign objects are often inserted into the lock through the keyhole to disable the lock. The foreign objects such as toothpicks, chewing gun or pieces of paper will be held in the keyhole so that the key for the lock is impossible to access the locking pins. The key only pushes the foreign objects further into the keyhole, which keeps the lock from being operated normally.

To overcome the shortcomings, the present invention provides an improved lock and a method to open the lock to mitigate or obviate the problems with conventional locks.

SUMMARY OF THE INVENTION

The main objective of the invention is to provide a lock that is difficult to pick through the keyhole of the lock.

Another objective of the invention is to provide a two step method a lock with a cylinder plug that has a multifaceted keyhole defined completely through the cylinder plug so a key can pass completely through the keyhole to remove jammed foreign objects such as toothpicks, chewing gun or pieces of paper before opening the lock and a method of opening such a lock.

A lock and a two step method to open the lock in accordance with the present invention presses key serrations completely through the lock before the serrations can be pulled back into and unlock the lock. The lock has a cylinder keyhole and an inner space communicating with the cylinder keyhole and comprises a cylinder plug and a locking pin assembly. The cylinder plug is rotatably mounted in the inner space and has a dummy and a cylinder plug keyhole defined completely through the cylinder plug. The locking pin assembly has multiple locking pins that are slidably held in the cylinder plug keyhole. The key has serrations that are inserted into the dummy keyhole from the front of the lock, extend out of the dummy keyhole and are aligned with the cylinder plug keyhole. The key is pulled backward so the serrations slide into the cylinder plug keyhole and push the locking pins to permit the cylinder plug to be rotated. Consequently, turning the key will open the lock. Furthermore, the key removes any foreign objects such as toothpicks, chewing gun or pieces of paper from the keyholes before the lock is opened.

Other objectives, advantages and novel features of the invention will become more apparent from the following detailed description when taken in conjunction with the accompanying drawings.

DETAILED DESCRIPTION OF PREFERRED EMBODIMENT

Figure 1:
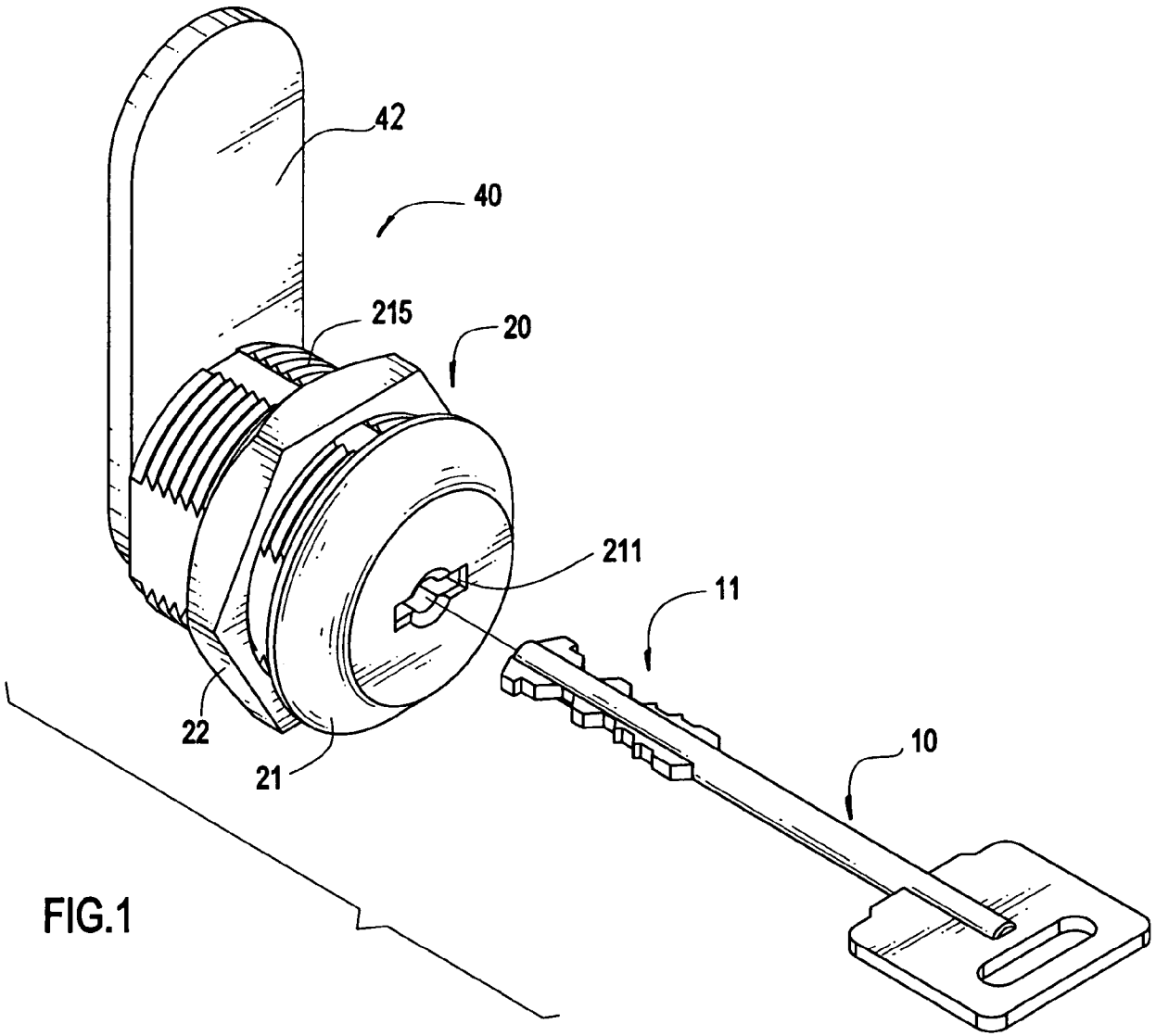
FIG. 1 is a perspective view of a first embodiment of a lock in accordance with the present invention and a key for the lock.
Figure 2:
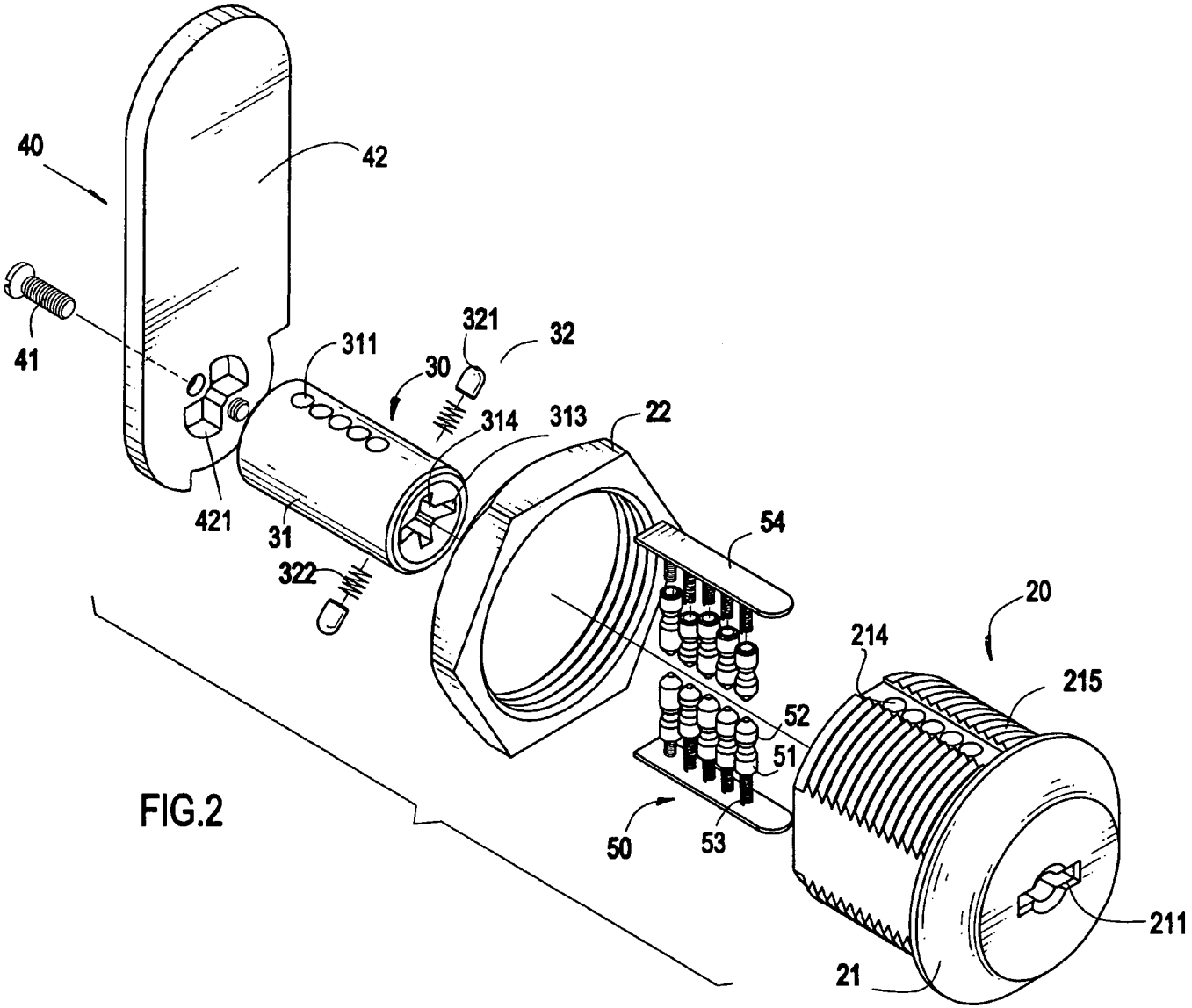
FIG. 2 is an exploded perspective view of the lock in FIG. 1.

With reference to FIGS. 1 and 2, a first embodiment of a lock in accordance with the present invention comprises a cylinder assembly (20), a cylinder plug assembly (30), a latch assembly (40) and a locking pin assembly (50). The lock uses a key (10) with serrations (11) to open it.

Figure 3:
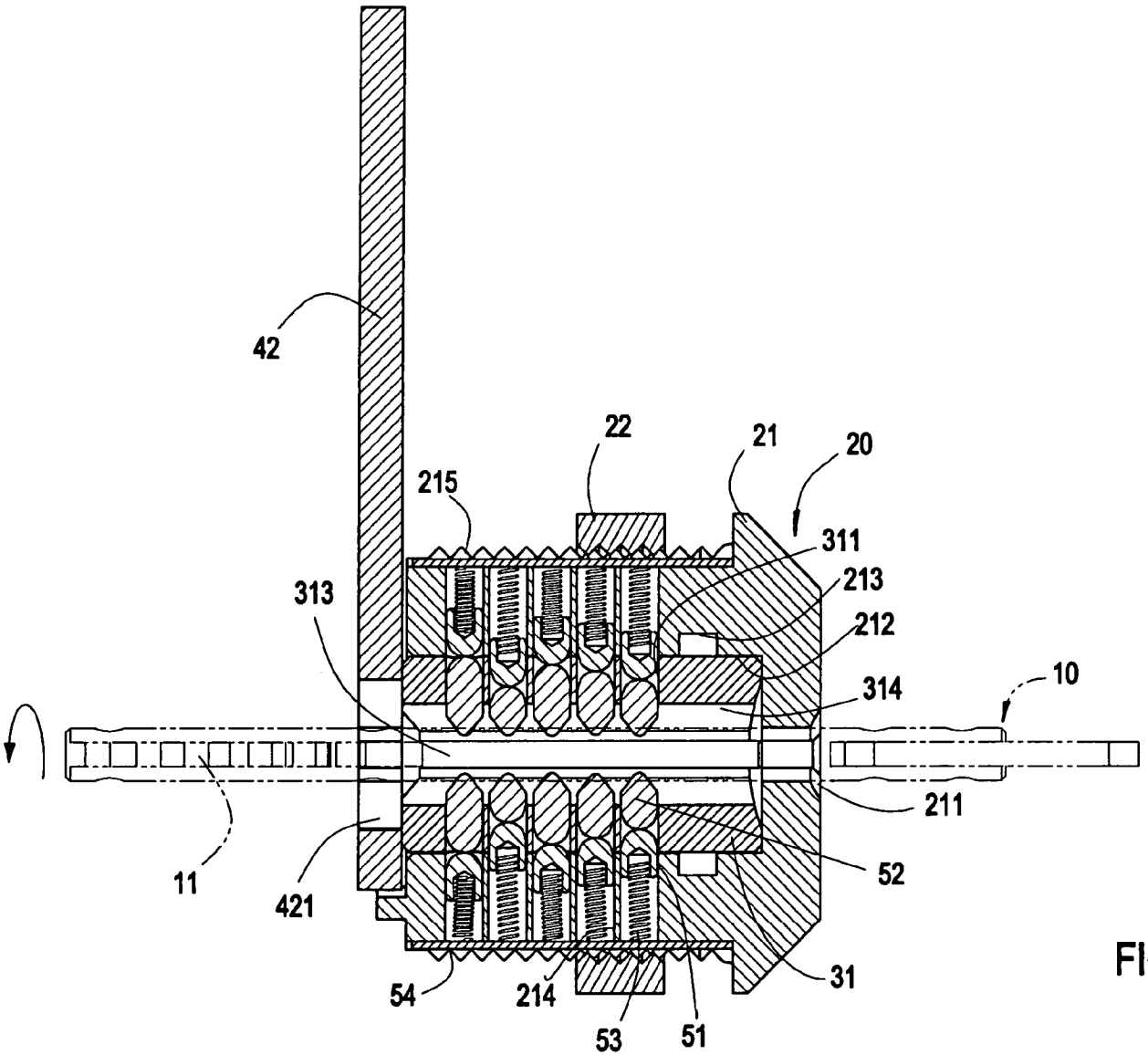
FIG. 3 is a cross sectional side plan view of the lock in FIG. 1 with a key inserted completely into the lock.

With further reference to FIG. 3, the cylinder assembly (20) comprises a cylinder (21) and a retainer (22). The cylinder (21) has an exterior surface, a cylinder keyhole (211), an inner space (212), an inner groove (213), multiple outer pin holes (214) and an exterior thread (215). The cylinder keyhole (211) communicates with the inner space (212). The inner space (212) rotatably holds the cylinder plug assembly (30). The outer pin holes (214) are defined completely through the cylinder (21) to communicate with the inner space (212) and may be arranged along two straight lines diametrically opposite to each other. The inner groove (213) is defined in the inner space (212) between the cylinder keyhole (211) and the outer pin holes (214). The exterior thread (215) is defined on the exterior surface of the cylinder (21).

Figure 4:
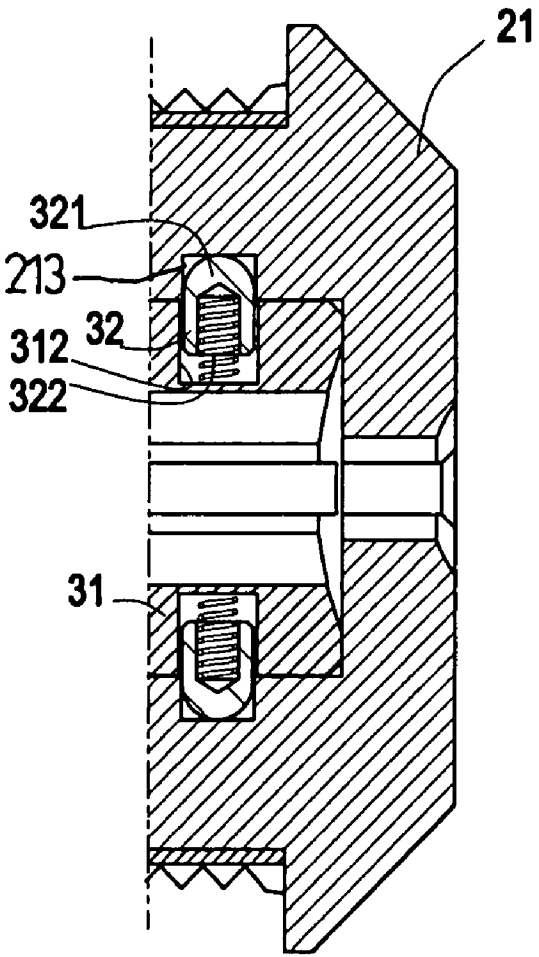
FIG. 4 is a cross sectional side plan view of a segment of the lock in FIG. 1.

With further reference to FIG. 4, the cylinder plug assembly (30) is rotatably held in the inner space (212) of the cylinder (21) and comprises a cylinder plug (31) and a resilient positioning device (32). The cylinder plug (31) is rotatably held in the inner space (212) of the cylinder (21) and has an exterior surface, multiple inner pin holes (311), two blind holes (312), a dummy keyhole (313) and a cylinder plug keyhole (314). The dummy keyhole (313) and the cylinder plug keyhole (314) are defined axially completely though the cylinder plug (31), are selectively aligned with the cylinder keyhole (211) in the cylinder (21) and are oriented at an angle relative to each other, preferably as a cross. Such an arrangement allows the serrations (11) of the key (10) to pass through either the dummy keyhole (313) or the cylinder plug keyhole (314).

The inner pin holes (311) are defined completely through the exterior surface of the cylinder plug (31), communicate with the cylinder plug keyhole (314) and are aligned respectively with the outer pin holes (214). The blind holes (312) are diametrically defined in the exterior surface of the cylinder plug (31) and are aligned with the inner groove (213) in the cylinder (21).

The resilient positioning device (32) holds the cylinder plug (31) in place in the inner space (212) and comprises two positioning pins (321) and two resilient elements (322). A resilient element (322), such as a spring, and a positioning pin (321) is mounted in each blind hole (312). The positioning pins (321) extend out of the associated blind holes (312) and into the inner groove (213) in the cylinder (21) and slide along the inner groove (213) as the cylinder plug (31) rotates relative to the cylinder (21) to hold the cylinder plug (31) rotatably in the inner space (212) of the cylinder (21). The positioning pins (321) may be made of resilient materials.

The latch assembly (40) comprises a transverse latch (42) and two fasteners (41). The transverse latch (42) is attached to the cylinder plug (31) with the fasteners (41) such as bolts, is rotated by the cylinder plug (31) and has a through hole (421). The through hole (421) is defined completely through the transverse latch (42) and corresponds to the dummy keyhole (313) and the cylinder plug keyhole (314).

The locking pin assembly (50) comprises multiple outer locking pins (51), multiple inner locking pins (52), multiple biasing elements (53) and two end covers (54). Each of the outer locking pins (51) is slidably held in a respective one of the outer pin holes (214). Each of the inner locking pins (52) is slidably held in a respective one of the inner pin holes (311) and is pressed by the corresponding outer locking pin (51) in the aligned outer pin hole (214). Each of the biasing elements (53) can be a spring and is held in a respective one of the outer pin holes (214) to produce a restitution force acting on the corresponding outer locking pin (51) in the outer locking pin hole (214).

The end covers (54) are mounted on the exterior surface of the cylinder (51) to cover respectively the in-line outer locking holes (214).

Figure 5:
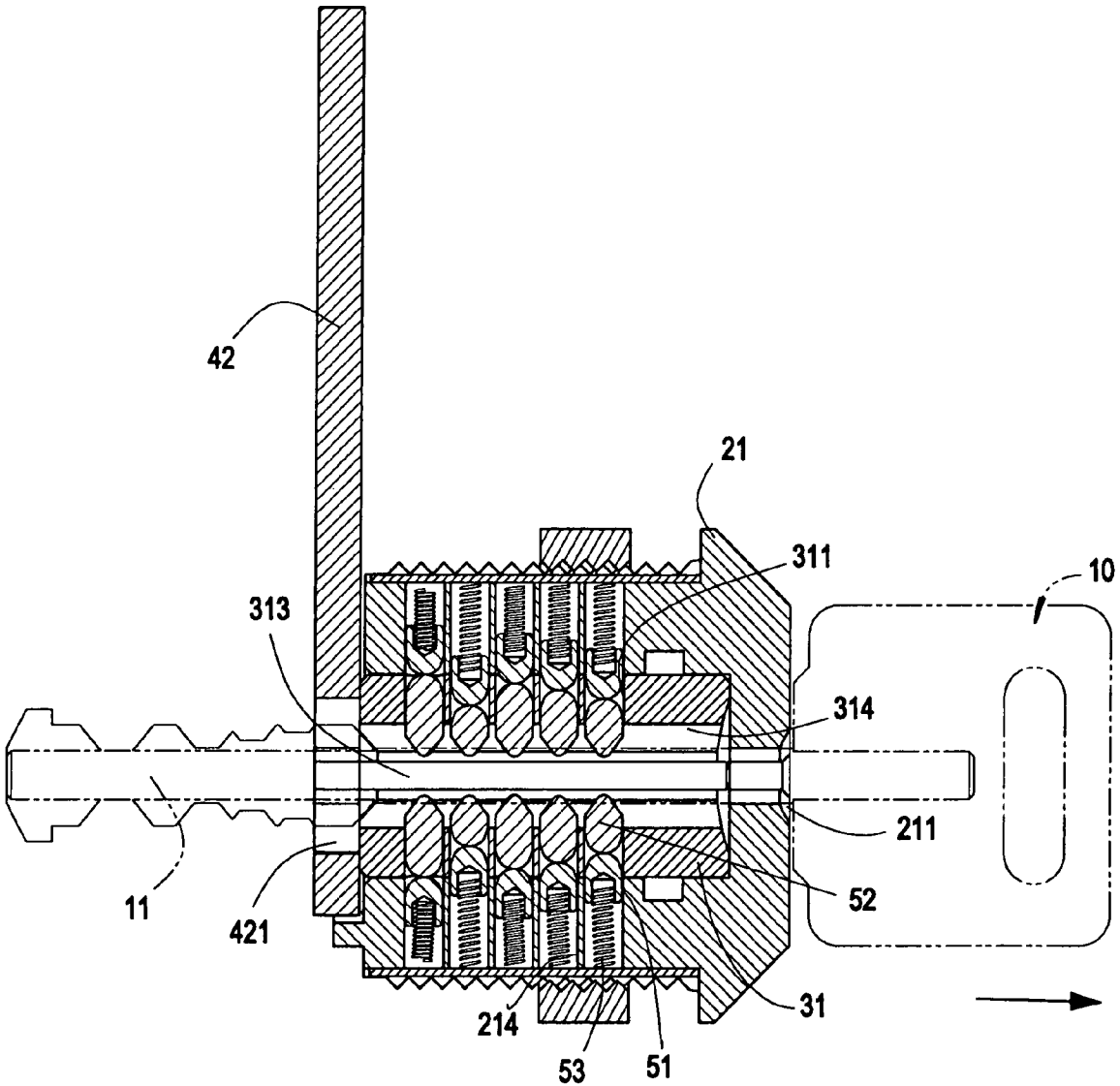
FIG. 5 is a cross sectional side plan view of the lock in FIG. 3 with the key serrations aligned with a cylinder plug keyhole in the cylinder plug of the lock.
Figure 6:
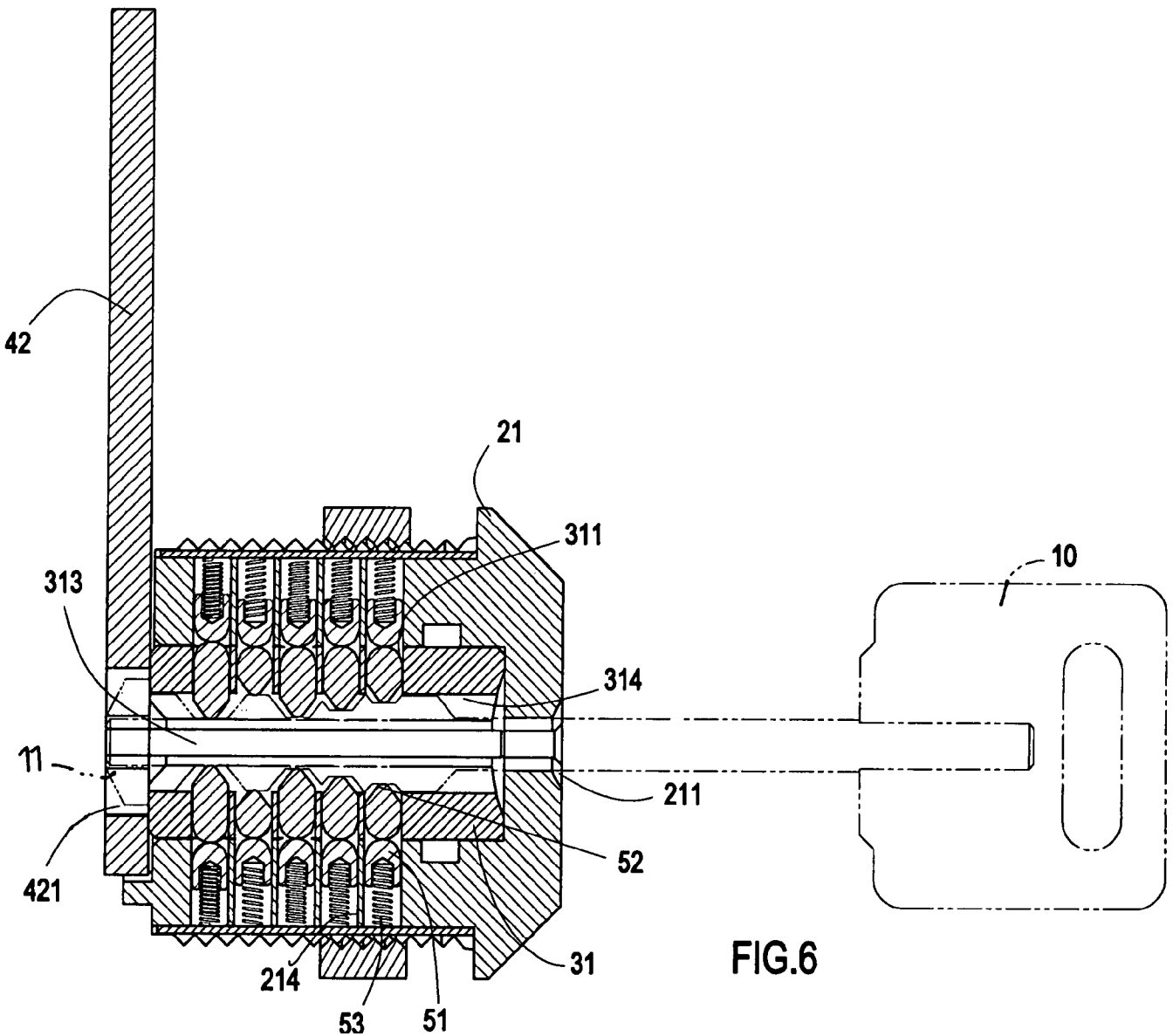
FIG. 6 is an operational, cross sectional side plan view of the lock in FIG. 5 with the key serrations pulled into the cylinder plug keyhole to open the lock.

With further reference to FIGS. 5 and 6, the two step method to open the lock using the key (10) comprises the steps of inserting the serrations (11) of the key (10) into the dummy keyhole (313), pressing the serrations (11) completely through the lock, rotating and aligning the serrations (11) with the cylinder plug keyhole (314), pulling the serrations (11) into the cylinder plug keyhole (314) and turning the key (10) to open the lock. The key (10) is inserted into the dummy keyhole (313) in the cylinder plug (31) through the cylinder keyhole (211) in the cylinder (21). The key (10) is pushed through the dummy keyhole (313) until the serrations (11) extend out of the back of the lock. After the serrations (11) of the key (10) are rotated and aligned with the cylinder plug keyhole (314), pulling the serrations (11) back into the cylinder plug keyhole (314) pushes the inner locking pins (52) to allow the cylinder plug (31) to be rotated and the key (10) to be turned to open the lock. The transverse latch (42) will rotate with the cylinder plug (31).

Inserting the key (10) into the dummy keyhole (313) and pressing the serrations (11) of the key (10) out of the back of the lock will remove any foreign objects jammed into the lock. The lock will operate normally when the foreign objects have been completely removed.

Furthermore, a person attempting to open the lock with a long and thin pick inserted through the cylinder keyhole (211) will find opening the lock impossible because of the dummy keyhole (313). The long and thin pick can only reach the dummy keyhole (313) and will not easily directly access the inner locking pins (52) on the cylinder plug keyhole (314) so that the lock is difficult to pick through the cylinder keyhole (211). The lock in accordance with the present invention provides a reliable effect of locking.

Figure 7:
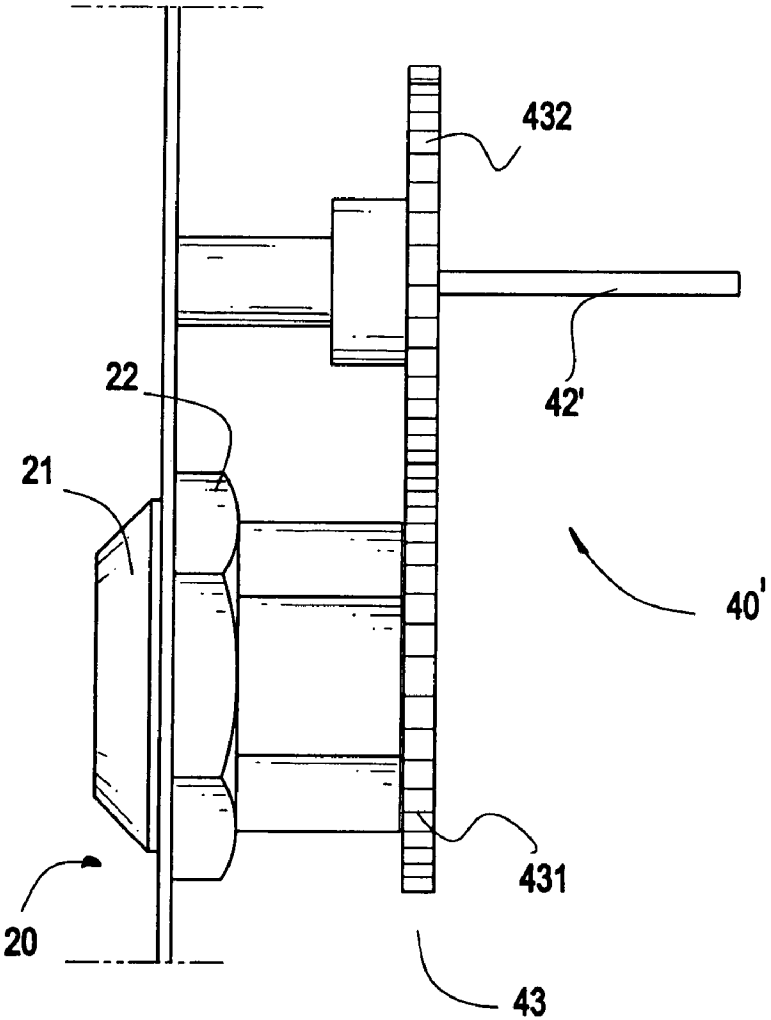
FIG. 7 is an operational side plan view of the lock in FIG. 1 with a modified latch assembly.

With reference to FIG. 7, a second embodiment of the latch assembly (40') comprises a transmission device (43) and an offset latch (42'). The transmission device (43) comprises a pinion gear (431) and a bull gear (432). The pinion gear (431) is attached to the cylinder plug (31) and meshes with the bull gear (432). The offset latch (42') is attached coaxially to the bull gear (432) and is rotated by the bull gear (432) as the pinion gear (431) is rotated.

Figure 8:
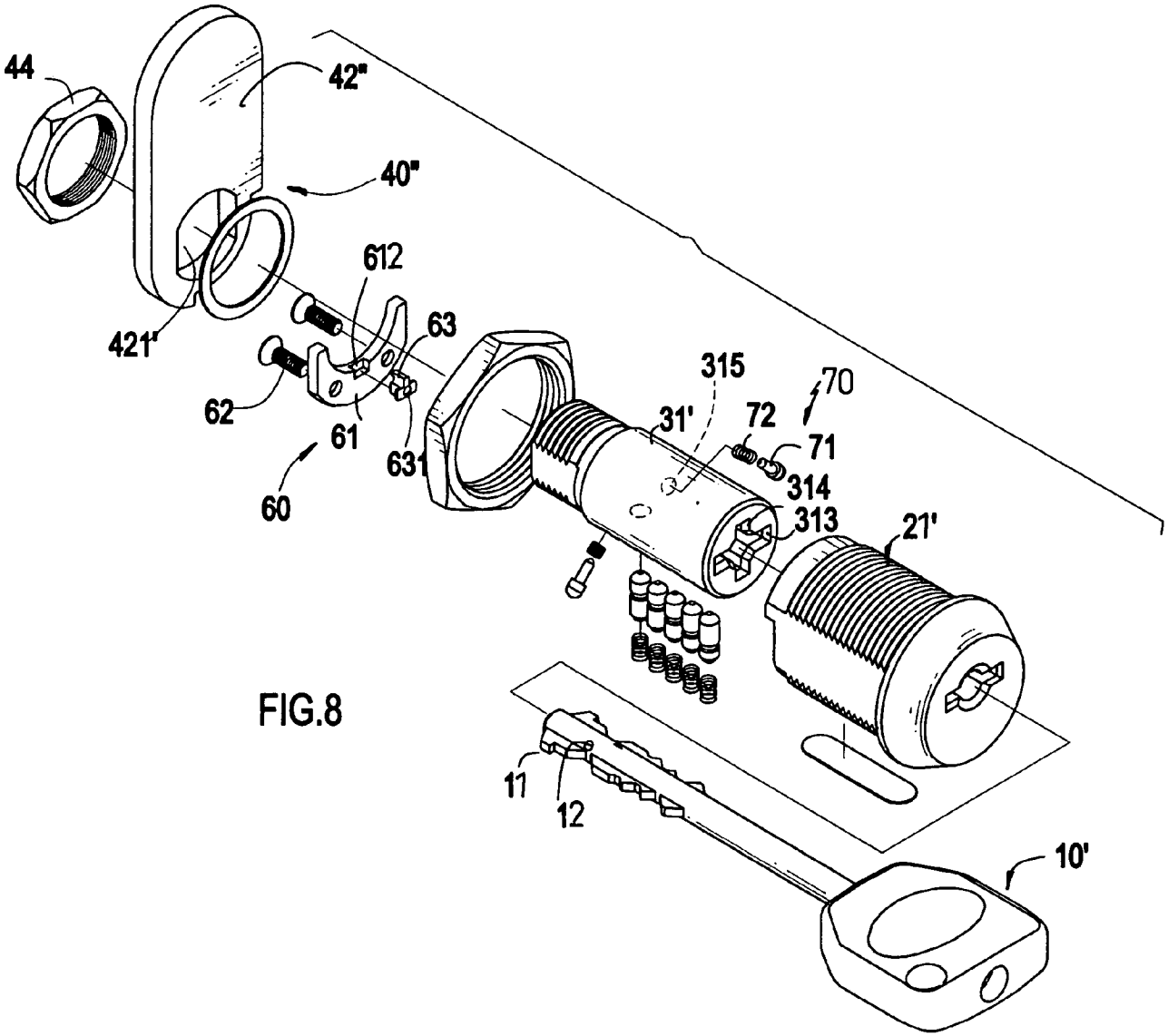
FIG. 8 in an exploded perspective view of a second embodiment of a lock in accordance with the present invention.
Figure 9:
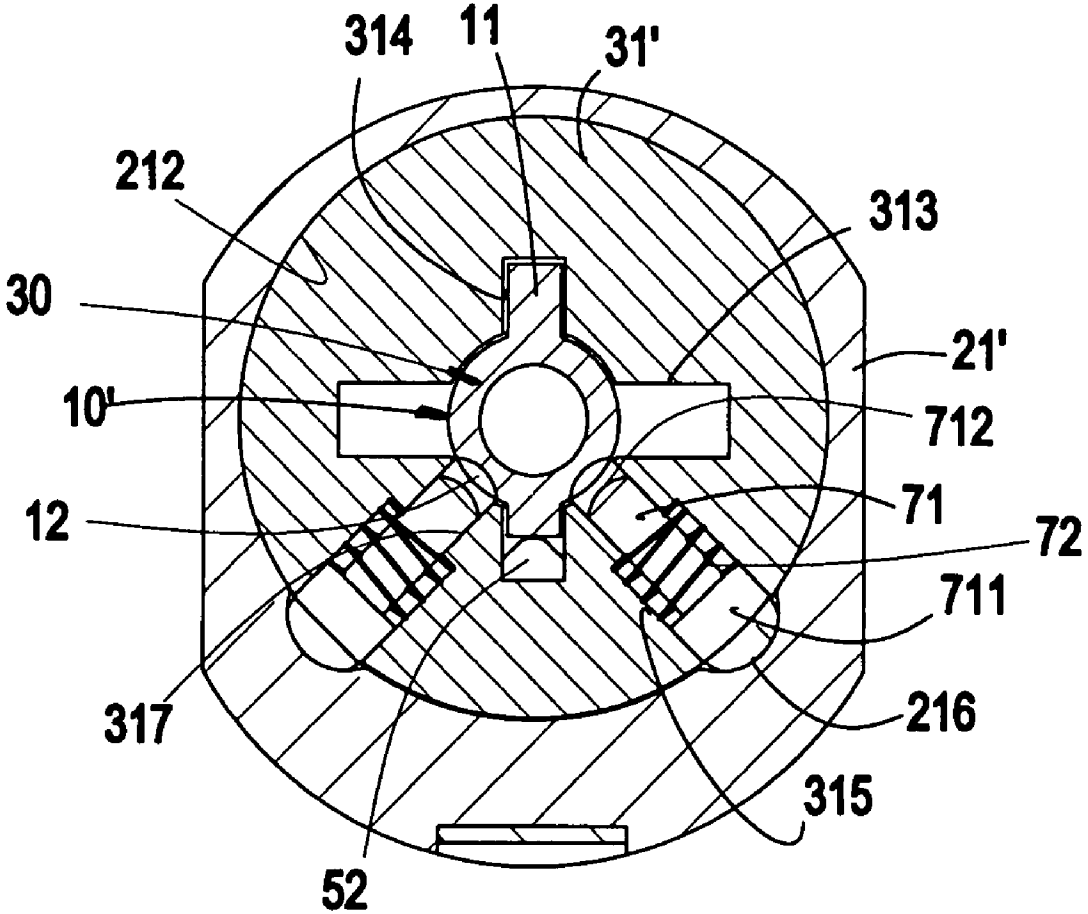
FIG. 9 is a rear elevational view in partial section of the lock in FIG. 8.

With reference to FIGS. 8 and 9, a second embodiment of a lock in accordance with the present invention is a modification of the first embodiment and the modification is implemented with a cylinder (21'), a cylinder plug (31'), a latch assembly (40"), a cylinder plug detent assembly (60) and a supplementary locking pin assembly (70). The lock uses a key (10') with serrations (11) and multiple key recesses (12) to unlock the lock.

The cylinder (21') further has multiple outer supplementary pin detents (216). The outer supplementary pin detents (216) are defined in the inner space (212).

Figure 10:
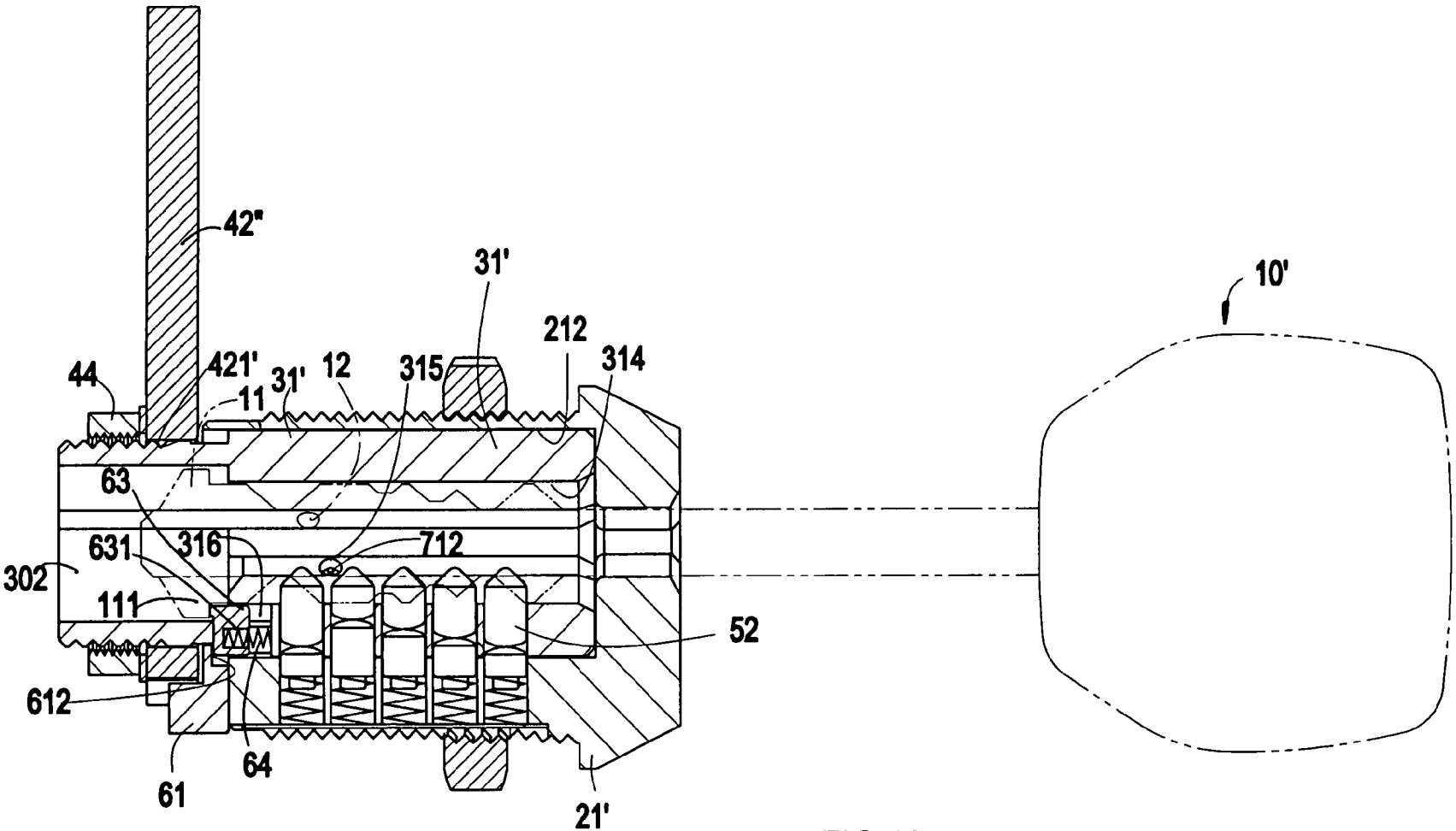
FIG. 10 is an operational side elevational view in partial section of the lock in FIG. 8.

With further reference to FIG. 10, the cylinder plug (31') further has multiple inner supplementary pin holes (315) and a rear recess (316). The inner supplementary pin holes (315)

are countersunk holes with shoulders (317), are defined completely through the exterior surface of the cylinder plug (31') to communicate with the keyholes (313, 314) and are respectively aligned with the outer supplementary pin detents (216) in the cylinder (21'). The rear recess (316) is aligned with the cylinder plug keyhole (314).

The latch assembly (40") comprises a transverse latch (42") and a latch retainer (44). The transverse latch (42") is attached to the cylinder plug (31') with the latch retainer (44), is rotated by the cylinder plug (31') and has a through hole (421'). The through hole (421') is defined completely through the transverse latch (42") and holds a segment of the cylinder plug (31') with the latch retainer (44).

The cylinder plug detent assembly (60) is mounted on the lock, is aligned with the cylinder plug hole (314) and comprises a stationary bracket (61), multiple tightening bolts (62), a sliding block (63) and a restitution element (64). The stationary bracket (61) is attached to the cylinder (21') with the tightening bolts (61) and has a notch (612) aligned with the rear recess (316) in the cylinder plug (31'). The sliding block (63) is slidably mounted in both the notch (612) and the rear recess (316) with the restitution element (64) and has a blind hole (631). The restitution element (64) is a spring and is mounted in the blind hole (631) and the rear recess (316) to push the sliding block (63) to extend into and engage the notch (612) to keep the cylinder plug (31') from being rotated relative to the cylinder (21').

The supplementary locking pin assembly (70) is mounted in the inner supplementary pin holes (315) in the cylinder plug (31') and comprises multiple supplementary pins (71) and multiple springs (72). Each of the supplementary pins (71) has an enlarged outer end (711) and an inner end (712). The enlarged ends (711) are respectively received in the outer supplementary pin detents (216) of the cylinder (21'). The inner ends (712) extend toward the keyholes (313, 314) and are correspond to the key recesses (12) in the key (10') when the key (10') is aligned with and pulled back into the cylinder plug keyhole (314) with the serrations (11) pushing the inner locking pins (52). The springs (72) are respectively mounted around the supplementary pins (71) in the supplementary pin holes (315) in the cylinder plug (31') between the corresponding enlarged heads (711) and the shoulders (317).

Figure 11:
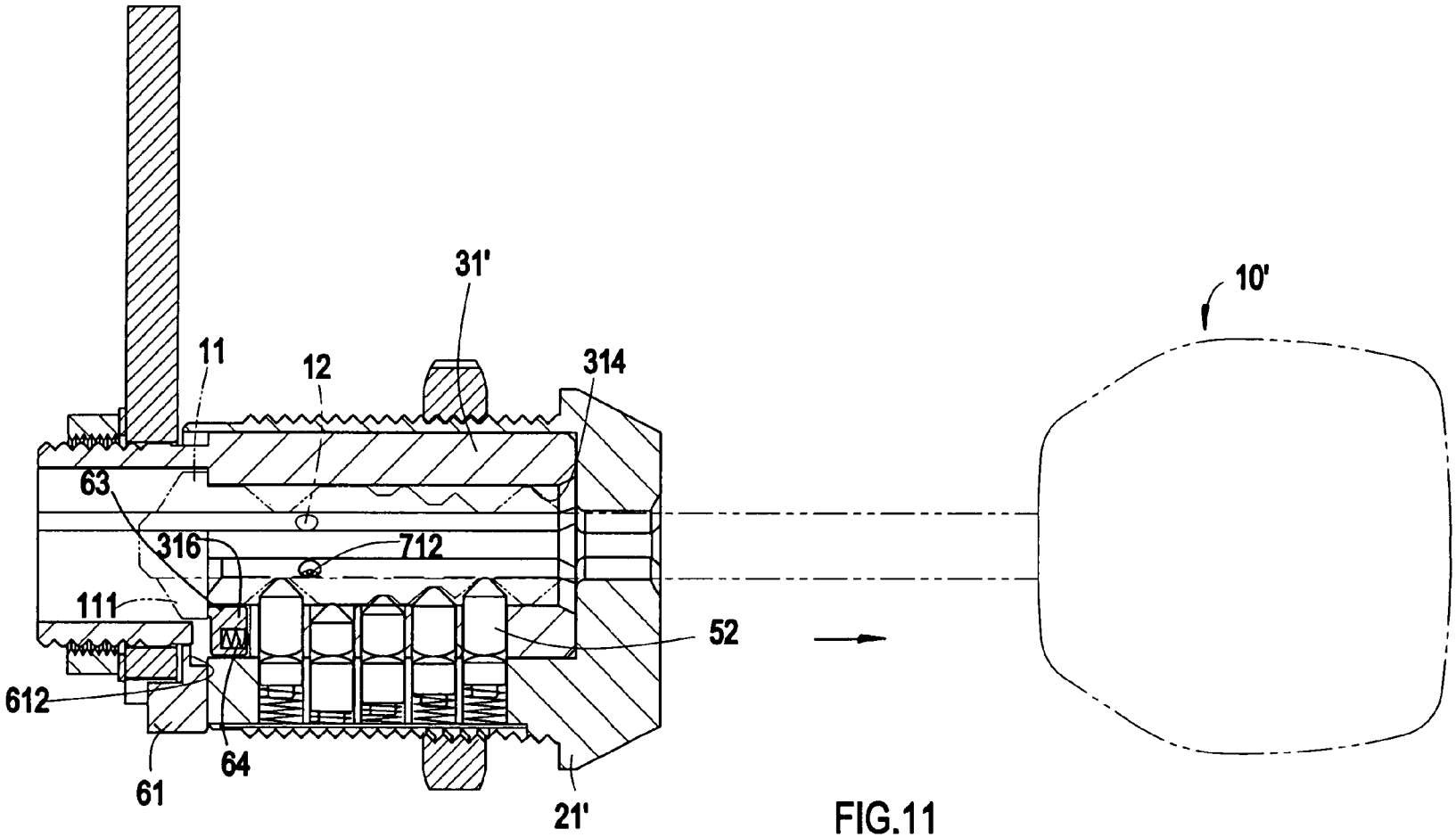
FIG. 11 is an operational side elevational view in partial section of the lock in FIG. 8 when the serrations of the key are pulled back into the cylinder plug keyhole in the cylinder plug of the lock.
Figure 12B:
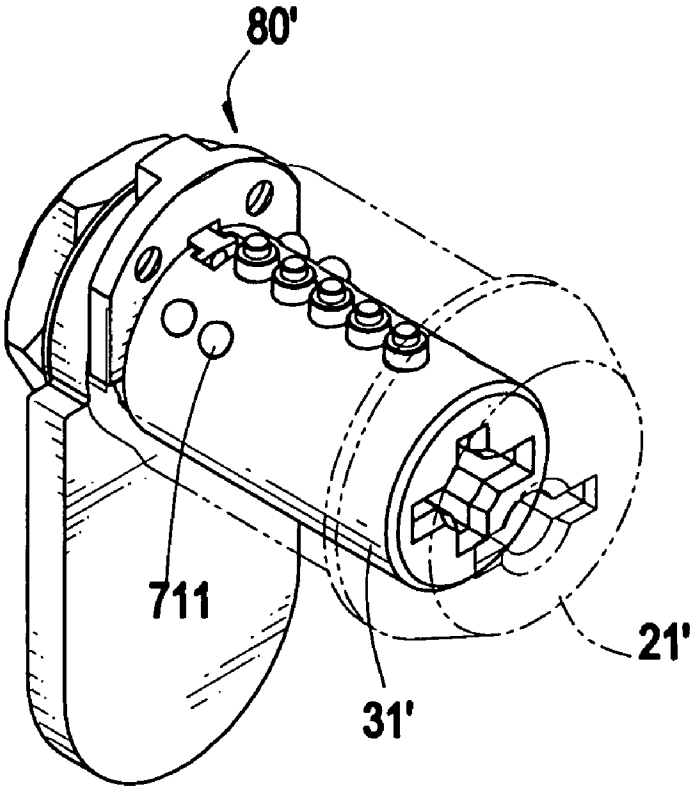
FIG. 12*b* is perspective view of a lock with a second kind of arrangement of a supplementary locking pin assembly in accordance with present invention.
Figure 12A:
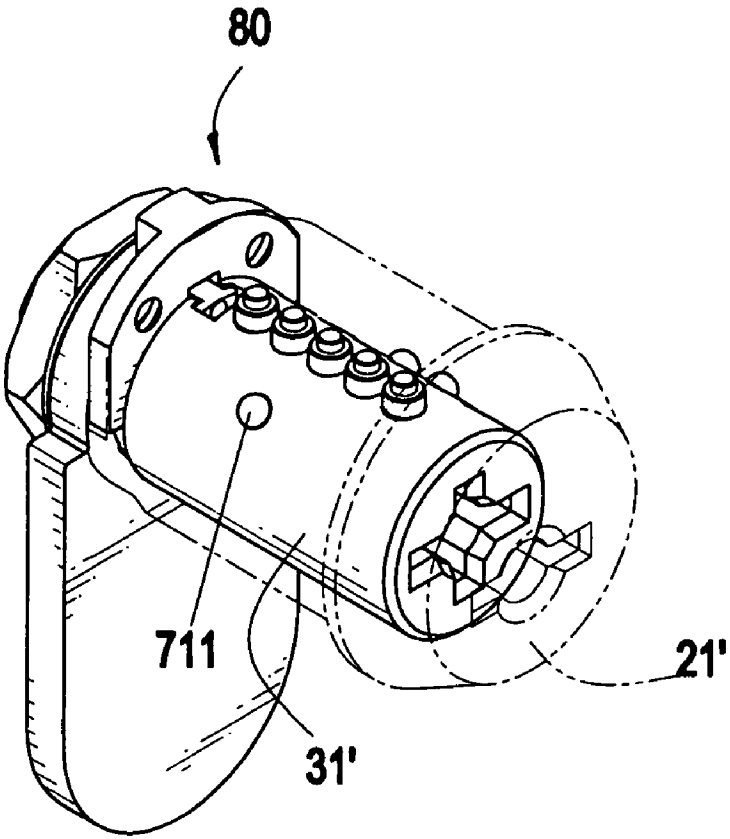
FIG. 12*a* is perspective view of a lock with a first kind of arrangement of a supplementary locking pin assembly in accordance with present invention.
Figures 13A, 13B, 13C:
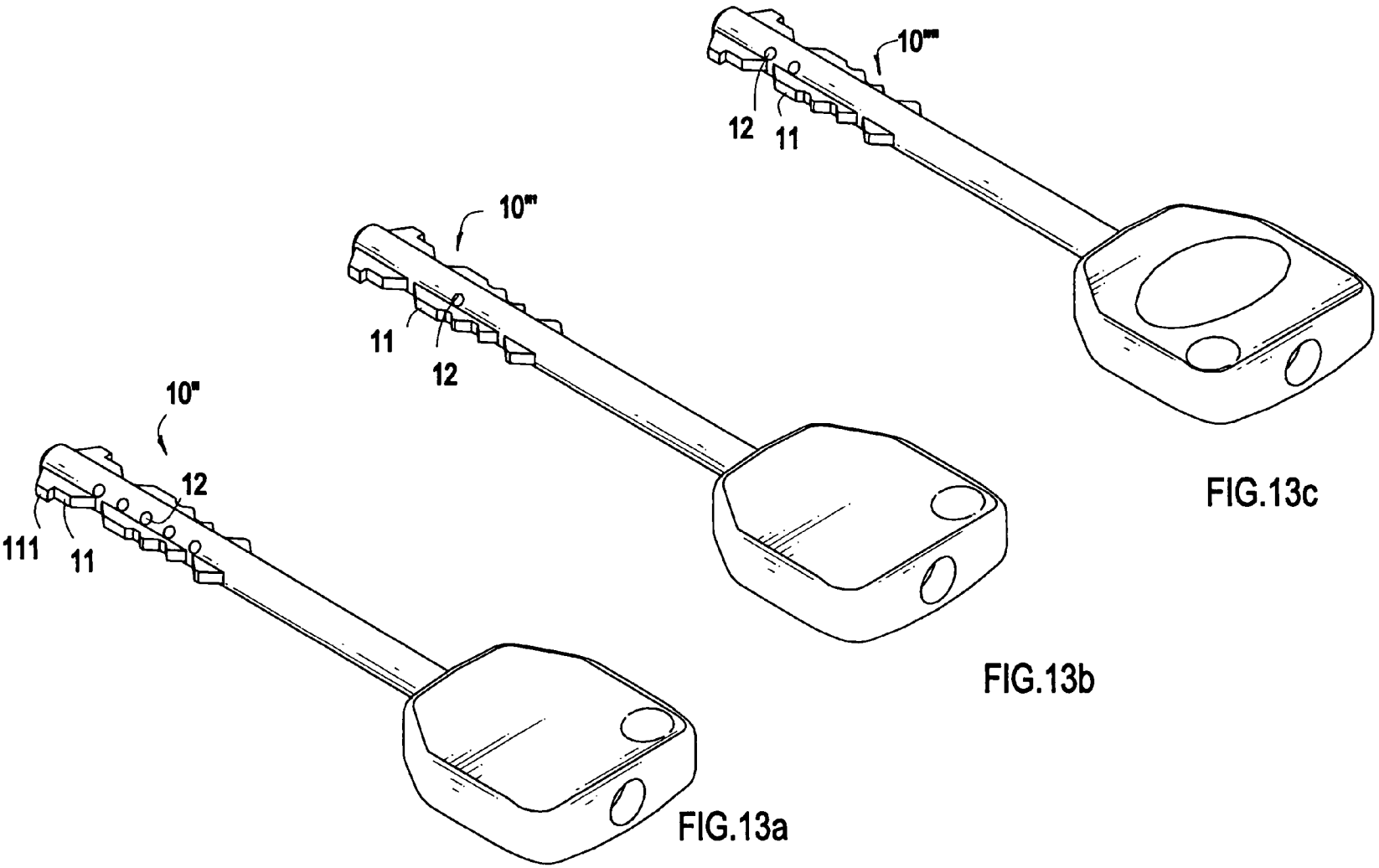
FIG. 13*a* is a perspective view of a universal key with multiple key recesses that opens the both locks in FIGS. 12*a* and 12*b;*
FIG. 13*b* is a perspective view of a key with a first arrangement of key recesses to open the lock in FIG. 12*a*.
FIG. 13*c* is a perspective view of a key with a second arrangement of key recesses to open the lock in FIG. 12*b*.

With reference to FIGS. 10 and 11, the key (10') further has a hooking nub (111). The hooking nub (111) is formed on one of the serrations (11) and hooks the sliding block (63) when the serrations (11) are reinserted into the cylinder plug keyhole (314). The hooking nub (111) draws the sliding block (63) to disengage from the notch (612) in the stationary bracket (61) when the serrations (11) of the key (10') is pulled back into the cylinder plug keyhole (314) to allow the cylinder plug (21') to be rotated. The key recesses (12) will respectively receive the inner ends (712) of the supplementary pins (71) to allow the enlarged outer end (711) to be slid out of the outer supplementary pin detents (216) of the cylinder (21') by rotations of the cylinder plug (31') when the cylinder plug (31') is rotated by the key (10').

Therefore, when the hooking nub (111) retracts the sliding block (63) into the rear recess (316) of the cylinder plug (31') and the serrations (11) are reinserted into the cylinder plug keyhole (314) with the key recesses (12) respectively aligned with the inner ends (711) of the supplementary pins (71), the cylinder plug (31') can be rotated relative to the cylinder (21') to open the lock.

With reference to FIGS. 12*a*, 12*b*, 13*a*, 13*b* and 13*c*, the design of the supplementary locking pin assembly (70) allows using a universal key (10") to open different locks (80, 80') that may be used for a public storage cabinet system. The keys (10''', 10'''') has common serrations (11) and different arrangements of key recesses (12) so that the keys (10''', 10'''') can only open respectively the corresponding locks (80, 80'). The universal key (10") with the common serrations (11) and multiple in-line key recesses (12) that will allow to receive any corresponding inner end (712) of the supplementary pin (71) so that can open the different locks (80, 80') for a person who manages the cabinet system.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A lock comprising:

a cylinder assembly comprising a cylinder having an inner space, multiple outer pin holes and a cylinder keyhole communicating with the inner space;

a cylinder plug assembly rotatably mounted in the inner space and comprising a cylinder plug rotatably mounted in the inner space and having an exterior surface;

a through passage extending an entire length of the lock and defining said cylinder keyhole at a first end of the lock, said through passage defining a through hole at a second opposing end of the lock;

a dummy keyhole and a cylinder plug keyhole defined coaxially completely through the cylinder plug, communicated with each other and selectively aligned with the cylinder keyhole, said dummy keyhole and said cylinder plug keyhole being in direct communication with said through passage;

multiple inner pin holes defined completely through the exterior surface of the cylinder plug to communicate with the cylinder plug keyhole, and the inner pin holes aligned respectively with the outer pin holes in the cylinder;

a locking pin assembly mounted in the cylinder and the cylinder plug and comprising multiple outer locking pins, and each of the outer locking pins being slidably held in a respective one of the outer pin holes;

multiple inner locking pins, and each of the inner locking pins being slidably held in a respective one of the inner pin holes and partially held in the aligned cylinder plug keyhole; and multiple biasing elements, and each of the biasing elements being held in a respective one of the outer pin holes to press the corresponding outer locking pin; and a latch assembly connected to and rotated by the cylinder plug, said through hole being formed in a portion of said latch assembly.

2. The lock as claimed in claim 1, wherein the cylinder further has an inner groove defined in the inner space; the cylinder plug further has two blind holes defined diametrically in the exterior surface of the cylinder plug and aligned with the inner groove; and the cylinder plug assembly further comprises a resilient positioning device to hold the cylinder plug in place in the inner space, and the resilient positioning device comprises two resilient positioning pins held respectively in the blind holes and slidably partially held in the inner groove.

3. The lock as claimed in claim 2, wherein each of the resilient positioning pins comprises a resilient element, and the resilient elements are respectively mounted and held in the blind holes.

4. The lock as claimed in claim 1, wherein the cylinder further has an exterior surface and an exterior thread defined in the exterior surface; the cylinder assembly further comprises a retainer screwing on the exterior thread; and the locking pin assembly further comprises two end covers attached to the exterior surface of the cylinder and between the retainer and the exterior surface of the cylinder to cover the outer locking pin holes.

5. The lock as claimed in claim 1, wherein the dummy keyhole and the cylinder plug keyhole are arranged in a cross configuration.

6. The lock as claimed in claim 1, wherein the latch assembly comprises a transverse latch with said through hole formed therein, said through hole being aligned with the dummy keyhole and the cylinder plug keyhole, and the transverse latch is connected to and rotated by the cylinder plug.

* * * * *